US005704777A

United States Patent [19]

Measom

[11] Patent Number: 5,704,777

[45] Date of Patent: Jan. 6, 1998

[54] OUTDOOR GAS BURNER

[75] Inventor: S. Ty Measom, Logan, Utah

[73] Assignee: Dutro Company, Emeryville, Calif.

[21] Appl. No.: 689,011

[22] Filed: Jul. 30, 1996

[51] Int. Cl.[6] ..... F23D 14/14

[52] U.S. Cl. ..... 431/329; 126/375

[58] Field of Search ..... 431/329, 326; 126/39 H, 39 T

[56] References Cited

U.S. PATENT DOCUMENTS

| | | | |
|---|---|---|---|
| 3,975,140 | 8/1976 | Placek | 431/329 |
| 4,541,407 | 9/1985 | Sommers et al. . | |
| 4,705,020 | 11/1987 | Hahn . | |
| 4,960,378 | 10/1990 | Jannemann et al. . | |
| 5,240,411 | 8/1993 | Abalos . | |
| 5,468,145 | 11/1995 | Ferlin . | |

*Primary Examiner*—Carroll B. Dority
*Attorney, Agent, or Firm*—Harris Zimmerman

[57] ABSTRACT

A gas burner arrangement for outdoor use includes a burner cup formed of a bottom wall and a cylindrical side wall extending integrally from the bottom wall in a smoothly curved radius. The bottom wall includes a central aperture for receiving a Venturi tube gas supply inlet connection. A pair of cylindrical flame screens are supported on the bottom wall of the burner cup, disposed in coaxial relationship concentrically about the central aperture. A top cap is secured to the bottom wall by bolts or other fasteners to secure the screen members in place in proper spacing and alignment. The top cap includes a domed center to provide strength to the cap and to facilitate smooth, non-turbulent flow of the gas-air mixture from the Venturi tube gas supply to the flame screens. The side wall of the burner cup extends higher than the flame screens to provide substantial wind protection. The Venturi gas supply is adjusted to provide a sub-stoichiometric air mixture, so that combustion and flame occur at the outer surface of the outer flame screen, where ambient air provides sufficient oxygen for complete combustion. The burner forms a continuous flame disposed about the outer flame screen and extending radially outwardly from the outer flame screen toward the inner surface of the side wall of the burner cup.

12 Claims, 2 Drawing Sheets

OUTDOOR GAS BURNER

BACKGROUND OF THE INVENTION

The present invention relates to gas burners, and more particularly to a gas burner adapted for use in outdoor cooking.

The use of gas burners for cooking in outdoor settings has increased markedly, reflecting a growing interest among the public in camping activities, as well as the continuing popularity of outdoor entertaining. In such settings the cooking apparatus is usually a portable unit, either a portable device sized for easy vehicular transport, in the case of camping activities, or a stand-alone unit adapted for use on a patio, deck, or the like. In most cases the fuel is propane or a propane/butane mixture, and is supplied from a portable tank that may be refillable or disposable.

A common problem associated with outdoor cooking is the effect of wind on the operation and efficiency of the burner unit. Ambient air movement of only a few miles per hour may disrupt the transfer of heat energy from the burner unit to the cooking pot, due to the fact that the primary transfer mechanism is the convection of hot gases from the flame to and around the cooking pot. In addition, outdoor burner units typically require ambient air to provide oxygen for combustion, and the lateral air flow and turbulence of wind can disrupt the proper mixing of fuel and oxygen; e.g., flame jets on the leeward side of the burner may not receive sufficient oxygen for efficient combustion. Moreover, the lateral movement of the wind may distort the flame pattern emanating from the burner, further reducing the efficiency of the burner.

There are known in the prior art various forms of outdoor burner units that are designed to resist these wind effects. Such designs typically include some form of wind screen that circumscribes the burner unit and, in some cases, the lower portion of the cooking pot supported above the burner unit. These designs have proven to be effective in only a narrow range of circumstances.

These and other gas burner arrangements are usually optimized for operation at a preselected heat output range, and adjustment within that range is effective. However, these units are often difficult to adjust, in terms of heat output, when operated, e.g., in a low BTU range. Indeed, wind conditions may extinguish some burners when set for low heat output.

SUMMARY OF THE PRESENT INVENTION

The present invention generally comprises a gas burner arrangement that is designed for use in outdoor conditions. The burner features a fully adjustable heat output, with clean and efficient combustion throughout the full range of adjustability. Moreover, the burner is designed to be wind resistant at both low and high heat outputs. In addition, the design allows simple and uncomplicated assembly, and facilitates easy service in the field.

The gas burner of the invention includes a burner cup formed of a bottom wall and a cylindrical side wall extending integrally from the bottom wall in a smoothly curved radius. The bottom wall includes a central aperture for receiving a Venturi tube gas supply inlet connection. A pair of cylindrical flame screens are supported on the bottom wall of the burner cup, disposed in coaxial relationship concentrically about the central aperture. A top cap is secured to the bottom wall by bolts or other fasteners to secure the screen members in place in proper spacing and alignment. The top cap includes a domed upper extent to provide strength to the cap and to facilitate the smooth, non-turbulent flow of the gas-air mixture from the Venturi tube gas supply to the flame screens.

The side wall of the burner cup extends upwardly higher than the flame screens, so that the flame screens are shielded from ambient lateral air flow to provide substantial wind resistance. The flame screens are formed of stainless steel screen material or the equivalent. The hole size and effective flow opening of the screens are critical design parameters that determine gas flow and flame characteristics. The inner flame screen provides a smooth, uniform fuel flow through the entire annular extent of the flame screens. The Venturi gas supply is adjusted to provide a sub-stoichiometric air mixture, so that combustion and flame occur at the outer surface of the outer flame screen, where ambient air provides sufficient oxygen for complete combustion. The burner forms a continuous flame disposed about the outer flame screen and extending radially outwardly from the outer flame screen toward the inner surface of the side wall of the burner cup.

The burner cup, which forms a generally sealed combustion unit, also includes a plurality of drain holes formed in the bottom wall thereof and angularly spaced about the central axis of the burner cup. The drain holes permit release of some spills, and, furthermore, provide ingress of air to the combustion zone at the outer surface of the outer flame screen. The burner cup also is provided with a concentrically arranged annular shoulder that is dimensioned to be disposed between the inner and outer flame screens, and to define the spacing therebetween. The top cap includes a pair of annular shoulders and an outer flange disposed in concentric array and spaced apart to define two annular gaps that receive the inner and outer flame screens. Thus, joining the top cap to the burner cup secures the flame screens in the proper spacing and centration, so that the burner assembly is formed of only four major components that are easily assembled or disassembled for cleaning and service.

DESCRIPTION OF THE PREFERRED EMBODIMENT

Figure 2:
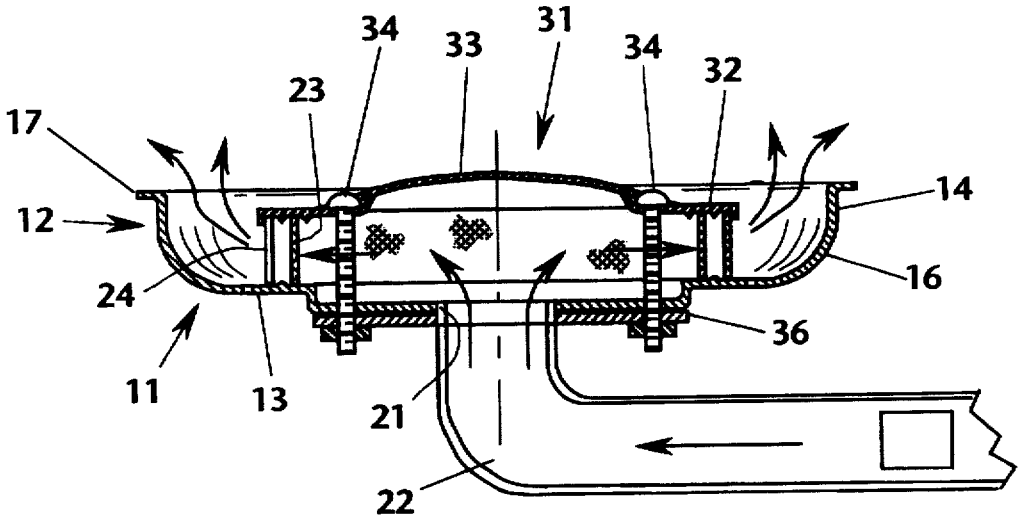
FIG. 2 is a cross-sectional elevation of the gas burner assembly of the present invention, taken along line 2—2 of FIG. 1.
Figure 1:
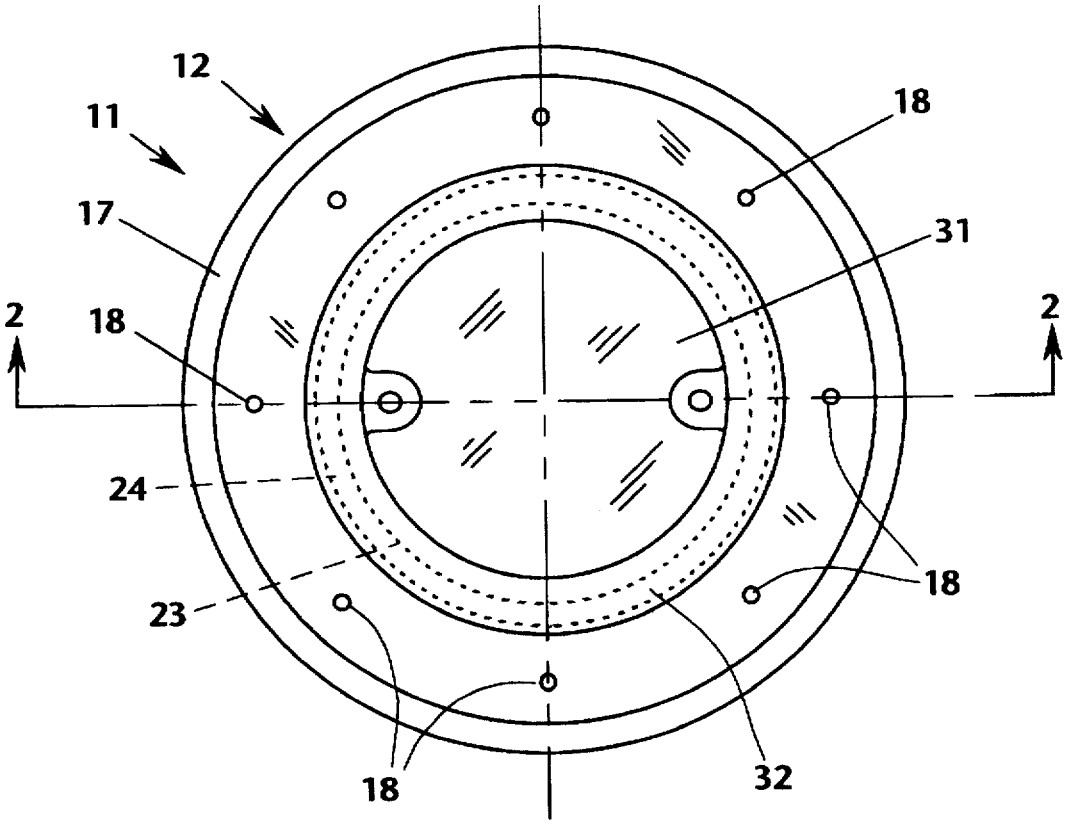
FIG. 1 is a plan view of the gas burner assembly of the present invention.
Figure 3:
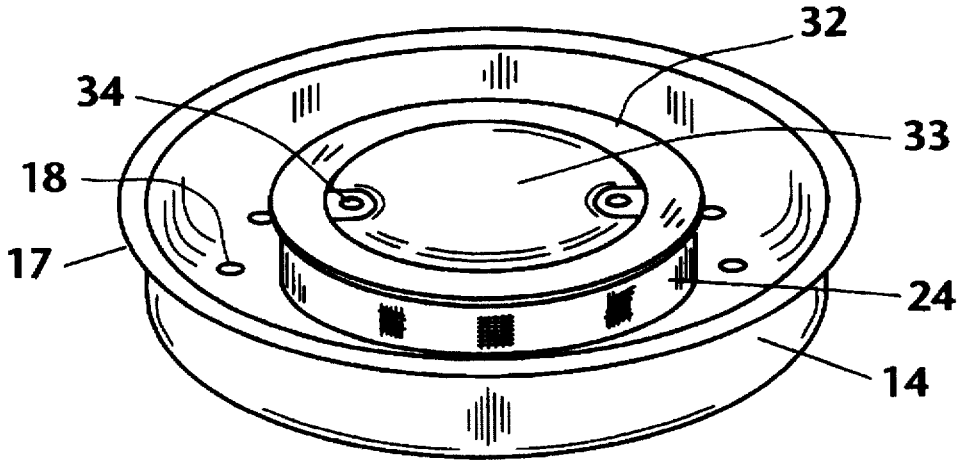
FIG. 3 is a perspective view of the gas burner assembly of the present invention.
Figure 4:
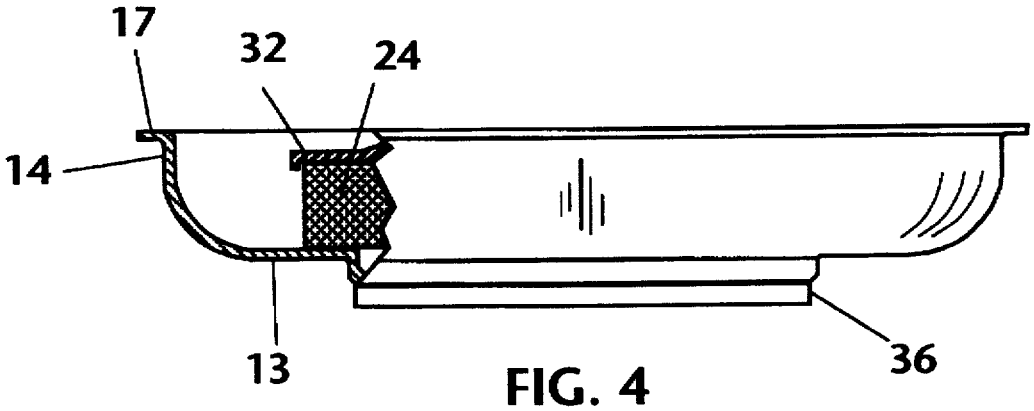
FIG. 4 is a partially cutaway side elevation of the gas burner assembly shown in FIGS. 1 and 2.

The present invention generally comprises a gas burner arrangement that is designed for use in outdoor conditions. With regard to the accompanying Figures, the gas burner assembly 11 of the invention includes a burner cup 12. The burner cup 12 is comprised of a bottom wall 13 and a cylindrical side wall 14 extending integrally from the periphery of the bottom wall. The junction of the bottom wall and side wall is formed by a smoothly radiused annular portion 16 that forms a streamlined transition therebetween. A flange 17 extends radially outwardly from the upper extent of the side wall 14. The bottom wall 13 of the burner cup 12 further includes a flanged central opening 21 dimensioned to connect to a Venturi tube gas supply inlet 22.

The gas burner assembly further includes a pair of flame screens 23 and 24, which comprise generally cylindrical screen members that are dimensioned to be concentric and coaxial with respect to the central opening 21. The flame screens may be formed of hardware cloth fabricated using stainless steel wire or the like, or may be formed of a cylindrical side wall that includes a plurality of closed spaced holes disposed in a regular array. A raised annular shoulder 26 is formed in the bottom wall of the burner cup, as shown in FIG. 5, to define the proper concentric spacing of the two burner screens 23 and 24.

Another major component of the burner assembly is a top cap 31, which includes a planar outer annulus 32 and a central shallow dome 33 formed integrally therewith. A pair of bolts 34 extend through the top cap and the interior space of the fire screens, and through holes in the burner cup bottom wall 13 to join the top cap to the burner cup, and to secure the fire screens therebetween. Thus the assembly is maintained intact with a minimum of components, and is easily opened for service or maintenance. Moreover, the bolts 34 may extend into a mounting plate 36 that supports the burner assembly within a cooking appliance.

Figure 5:
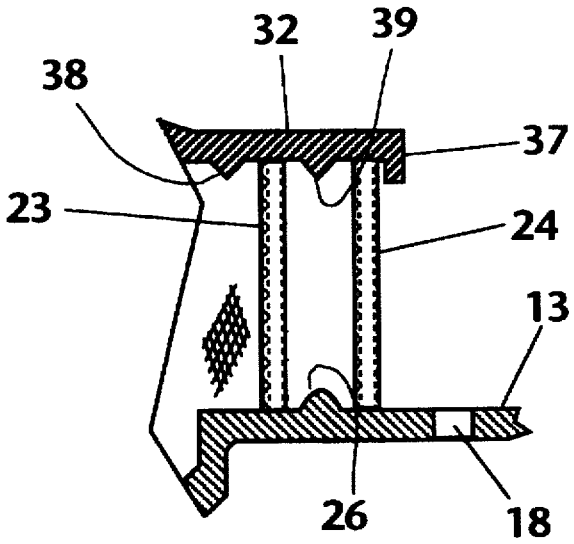
FIG. 5 is a magnified cross-sectional elevation showing the mounting of the flame screens between the burner cup and top cap of the gas burner assembly.

With regard to FIG. 5, the outer annulus 32 of the top cap 31 includes a peripheral flange 37 depending therefrom to retain the outer flame screen 24. In addition, the outer annulus 32 includes a pair of annular shoulders 38 and 39 extending downwardly therefrom to define therebetween and with the flange 37 a pair of gaps that serve to engage and position the flame screens 23 and 24 in the uniform concentric spacing that is required for optimum performance of the burner assembly.

The domed central portion 33 of the top cap 31 defines a plenum chamber that receives the gas/air mixture from the supply pipe 22 and distributes the mixture in a uniform, non-turbulent manner to the porous side walls defined by the flame screens 23 and 24. The domed portion further provides enhanced strength to the cap to resist downward loads from cooking pots, utensils, and the like.

The Venturi gas supply 22 is adjusted to provide a sub-stoichiometric air mixture, so that combustion and flame occur at the outer surface of the outer flame screen 24, where ambient air provides sufficient oxygen for complete combustion. The burner forms a continuous flame disposed about the outer flame screen 24 and extending radially outwardly from the outer flame screen 24 toward the inner surface of the side wall 14 of the burner cup 12. The burner cup 12 forms a generally sealed combustion unit, and it is significant that the side wall 14 extends upwardly higher than the outer annulus of the top cap 31. The side wall 14 thus forms an integral wind screen to protect the flame output from ambient lateral air movement.

The burner cup 12 is further provided with a plurality of drain holes 18 to release of minimal spills, and to admit some ambient air into the combustion zone at the outer surface of the outer flame screen 24. The burner cup is designed to have intrinsic strength, in that the flange 17 provides lateral rigidity, the flange of the opening 21 provides rigidity to the bottom wall 13, and the smooth radius 16 resists deformation in any direction.

The gas burner assembly 11 is adapted to operate using propane or propane/butane fuel, and to be fully adjustable and efficient from zero to 30,000 BTU/hr. The input pressure may range from zero to 18 psi to vary and select the desired heat output. All components may be fabricated of stainless steel or coated corrosion-resistant materials. The size may be adjusted to allow for even greater output ranges.

The foregoing description of the preferred embodiment of the invention has been presented for purposes of illustration and description. It is not intended to be exhaustive or to limit the invention to the precise form disclosed, and many modifications and variations are possible in light of the above teaching without deviating from the spirit and the scope of the invention. The embodiment described is selected to best explain the principles of the invention and its practical application to thereby enable others skilled in the art to best utilize the invention in various embodiments and with various modifications as suited to the particular purpose contemplated. It is intended that the scope of the invention be defined by the claims appended hereto.

I claim:

1. An outdoor gas burner assembly, including:

a burner cup comprised of a bottom wall and an integral side wall extending upwardly from the periphery of said bottom wall, said side wall extending vertically and configured in generally cylindrical fashion;

an opening disposed in said bottom wall to admit a fuel/air mixture to said burner assembly;

at least one fire screen disposed in concentric, spaced apart relationship with respect to said side wail, said at least one fire screen disposed coaxially with respect to said opening in said bottom wall;

a top cap disposed superjacently of said bottom wail and adapted to impinge on said at least one fire screen; said top cap including an outer annular portion adapted to impinge on an upper edge of said at least one fire screen, and an central annular portion having an upwardly extending convex dome configuration;

said opening disposed to direct said fuel/air flow unimpeded toward a medial portion of said convex dome configuration; and, fastener means for securing said top cap to said burner cup and to clamp and retain said at least one fire screen between said top cap and said bottom wall.

2. The outdoor gas burner assembly of claim 1, further including a plurality of drain holes formed in said bottom wall and spaced angularly about the axis of symmetry of said generally cylindrical side wall.

3. The outdoor gas burner assembly of claim 1, further including a smoothly radiused annular portion extending from said bottom wall to said side wall of said burner cup.

4. The outdoor gas burner assembly of claim 1, wherein said at least one fire screen includes inner and outer closed curved fire screens disposed in closely spaced concentricity, said outer fire screen defining a combustion zone extending continuously about the outer surface of said outer fire screen.

5. The outdoor gas burner assembly of claim 4, wherein said inner and outer fire screens include parallel side walls of substantially similar height.

6. The outdoor gas burner assembly of claim 5, wherein said outer annular portion includes a flange extending downwardly from an outer edge to secure said outer flame screen within the confines of said flange.

7. The outdoor gas burner assembly of claim 1, wherein said outer annular portion further includes a pair of concentric annular shoulders projecting downwardly from an inner surface of said outer annular portion to engage and fixedly position said inner and outer fire screens in a predetermined concentric spacing.

8. The outdoor gas burner assembly of claim 1, wherein said fastener means includes at least one bolt extending through said top cap to engage said bottom wall of said burner cup.

9. The outdoor gas burner assembly of claim 4, further including a raised annular shoulder extending upwardly from said bottom wall of said burner cup, said annular shoulder disposed to extend concentrically between said inner and outer fire screens and to define the concentric spacing between said inner and outer fire screens.

10. The outdoor gas burner assembly of claim 4, wherein said fuel/air mixture is in sub-stoichiometric proportions, and combustion takes place in combination with ambient air in a combustion zone surrounding said outer fire screen.

11. The outdoor gas burner assembly of claim 10, wherein said fuel/air mixture includes propane or propane/butane fuel.

12. The outdoor gas burner assembly of claim 11, wherein said fuel/air mixture is supplied at a variable pressure in the range of 0–18 psi to vary the heat output of said outdoor gas burner assembly.

* * * * *